United States Patent [19]

Wietsma

[11] 4,081,318

[45] Mar. 28, 1978

[54] PREPARATION OF IMPREGNATED FIBERS

[75] Inventor: Popke Wietsma, Velp, Netherlands

[73] Assignee: Chemische Industrie AKU-Goodrich B.V., Arnhem, Netherlands

[21] Appl. No.: 706,095

[22] Filed: Jul. 16, 1976

[30] Foreign Application Priority Data

Jul. 16, 1975 United Kingdom ..... 29798/75

[51] Int. Cl.[2] ..... D21F 11/00

[52] U.S. Cl. ..... 162/157 R; 162/168 R; 162/169; 162/186; 427/296; 427/373; 427/391; 427/428

[58] Field of Search ..... 162/186, 184, 168 R, 162/169, 168 N, 157 R; 427/296, 391, 428, 373

[56] References Cited

U.S. PATENT DOCUMENTS

| | | | |
|---|---|---|---|
| 2,426,043 | 8/1947 | Muggleton | 162/186 |
| 3,042,573 | 7/1962 | Roberts | 427/296 |
| 3,533,833 | 10/1970 | Takahashi et al. | 427/428 |
| 3,560,334 | 2/1971 | Arledter | 162/186 |
| 4,018,647 | 4/1977 | Wietsma | 162/168 N |

*Primary Examiner*—S. Leon Bashore
*Assistant Examiner*—Peter Chin

[57] ABSTRACT

A process is shown wherein an aqueous binder composition, preferably a latex binder composition, is foamed and applied as a layer of controlled thickness on a transfer roll rotating above a moving fibrous web but out of touch with the latter while suction is applied below the web in the region of the roll to draw the foam off the roll and into the web. The web is subsequently dried. The process produces webs of improved hand because impregnation is accomplished with only the foam coming into contact with the web.

3 Claims, 2 Drawing Figures

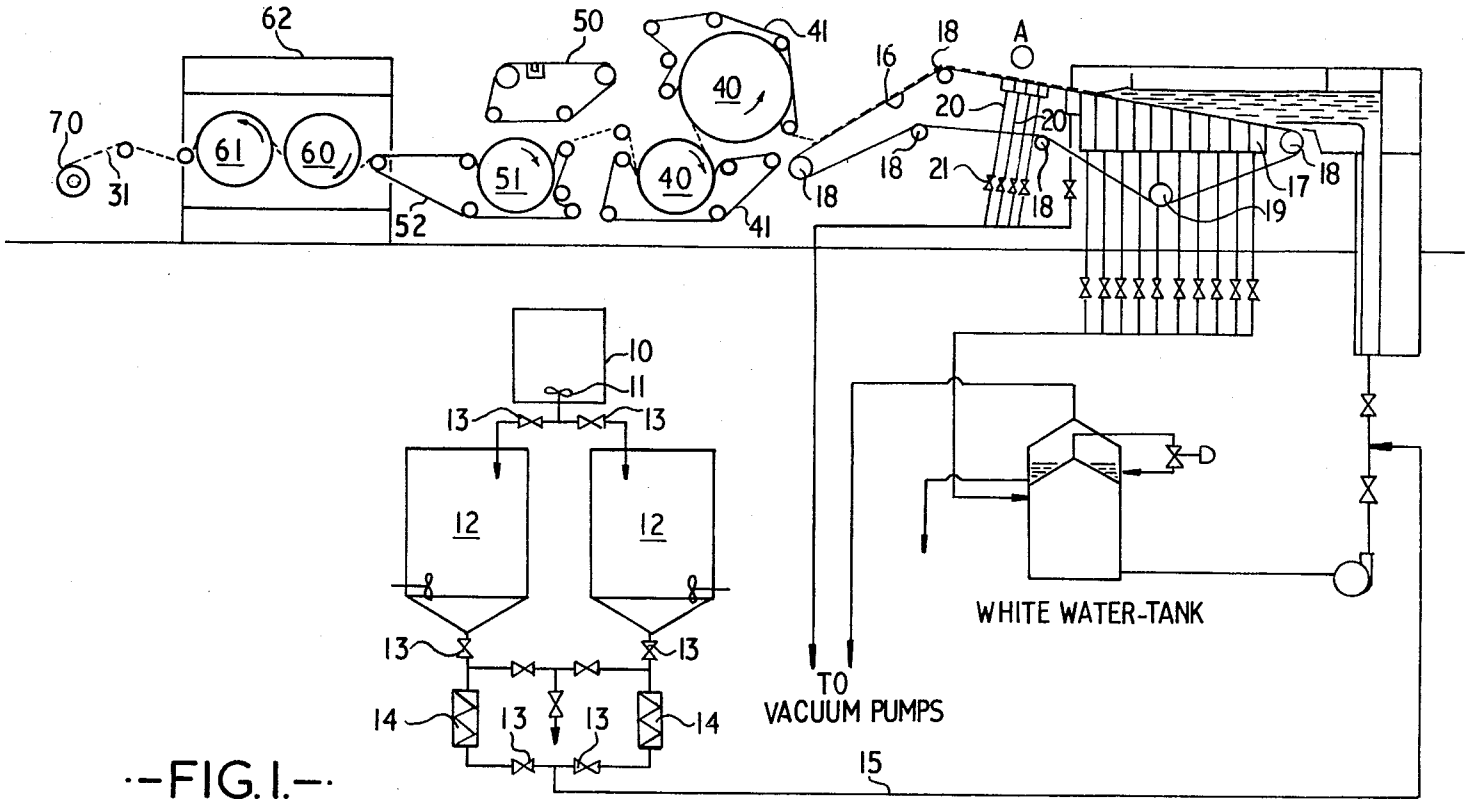
-FIG. 1.-

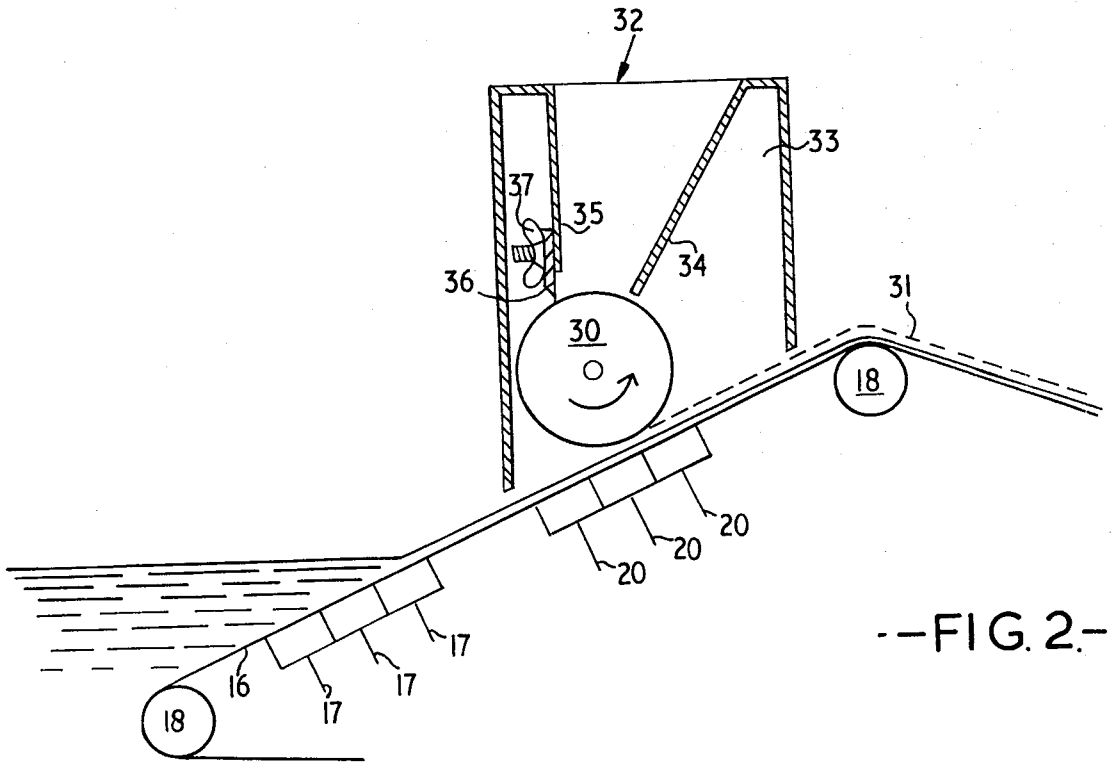
-FIG. 2-

PREPARATION OF IMPREGNATED FIBERS

BACKGROUND OF THE INVENTION

The present invention relates to a process which can be applied in the wet screen area of existing wet-laid web-making machines with only minor equipment and procedural modifications.

In the manufacture of non-woven fibrous webs on equipment resembling paper making machines using the wet method, in which an aqueous fibre suspension containing shredded (beaten) or non-shredded natural and/or synthetic fibres, is formed into a web on a screen and subsequently dried, the fibre web is given the necessary coherence by means of either an aqueous binder composition and/or melt fibres. Such binder composition or melt fibres can be added to the fibre suspension before formation of the web or it can be applied to the already-formed water-wet web in the wet screen section of the web-making machine.

The application of the binder material to the fibres while the latter are still suspended in water involves many problems of coagulation, mixing, uniformity of association between the fibres and the binder, and fouling of the broke boxes, beaters and screens of the web-making machines and also of the water effluent from the screen area of the equipment.

The application of latex-like binder compositions to the already-formed but still wet web in the web-making machine has taken various forms including applying the compositions on the dried or partially-dried web by spraying, impregnating or printing followed by a final finishing operation. The resulting products, however, have had a harsh paper-like feel which is undesirable for many applications of non-woven webs. These known methods have also been primarily applicable to the thinner, less bulky types of webs.

German Patent Specification No. 1,221,093 describes a process in which a binding composition in the form of an aqueous foam is applied to the water-wet fibre web between the initial screening section and the first drying cylinder of the web-making machine.

The products thus made do not have the requisite smooth surface and still require the drying treatment followed by impregnating, spraying or printing the once-impregnated web with a dispersion of a synthetic polymeric material such as rubber. Such a product has a paper-like feel or hand not at all desirable for many non-woven applications.

In our British Application No. 26540/74 there is described a process in which a heat-sensitized latex is formed and applied by a knife coater or doctor blade to the non-woven web in the wet screen area of the web-making machine where the normal dewatering suction sections under the screen are relied on to draw the foam into the web. Such a procedure is an improvement over prior procedures but still does not produce the very soft hand so desired in the product and, moreover, is limited to the preparation of the thinner or light weight webs. The knife coater is troublesome to utilize due to irregularity of the web and also due to pick up of fibre on the blade and requires constant attention of operators for cleaning and adjustment in order to approximate a constant concentration of binder on the web.

SUMMARY OF THE INVENTION

Surprisingly, it has been found that the above disadvantages may be overcome and fibre webs produced with a very soft, bulky hand of the best woven textiles if an aqueous binder composition, particularly a latex binder composition, is applied to the web as a foam without touching it or compressing it in any way by direct mechanical contact and suction is applied to the bottom surface of the screen in the immediate area where the binder composition first contacts the web.

According to the present invention there is provided a method for applying a foamed aqueous binder composition to a waterwetted fibrous web in which method the foamed binder composition, preferably having a density of at least 50 grams per liter, is applied or formed into a layer on a rotating cylindrical transfer surface disposed above a water-wetted web at a distance therefrom, which is more than the thickness of the aforesaid layer, moving the web under such rotating transfer surface, and applying suction to the underside of the moving web in the region thereof beneath the transfer surface to draw the fragile foamed binder off the transfer surface and into the web. The web is subsequently dried by applying heat in the range of 25° to 150° C.

Preferably the binder composition is a latex binder composition, and most preferably a latex binder composition which is heat sensitized so as to be set in the web at a temperature between about 25° and 95° C.

Further, the cylindrical transfer surface is preferably rotated at a speed sufficient to assist in projecting the foamed binder composition onto the top surface of the web.

Accordingly, the process of the invention provides a process, which when adapted to use in a wet-laid web-forming machine, comprises forming or applying a foamed aqueous binder composition as a uniform layer on a rotating transfer roll disposed above and transversely with respect to the web in the wet screen area of the machine and with the roll disposed at a distance above the web top surface at distance greater than the thickness of the binder layer on such roll, moving the web and screen beneath the roll whilst applying suction beneath web and screen in the region of the roll to draw the fragile foam off the transfer surface and into the web, and then drying the web. Where the foamed binder composition is a preferred heat-sensitized aqueous latex composition the heat of the first drier roll or rolls of the machine gels or coagulates the binder and fixes it to the fibres of the web bedore drying is completed.

Furthermore, the web is compressed very little or not at all by the application of the foam and its structure is thus most open and receptive to penetration of the foam under the pull of the section. In the subsequent first drying roll sections of the web-making machine, the application of heat dries or coagulates the foam, preferably a latex foam, within the water-wet web and drying of the impregnated web will take place.

One aspect of the present invention provides a process which produces a fiber web impregnated with a polymeric binder material and which has a better "hand", i.e. is softer and especially more bulky in character, than similar webs made in other ways.

A further aspect of the present invention provides a process which results in the preparation of a wet-laid fiber web uniformly impregnated with a foamed latex binder composition with the result that the web ahs a fabric-like rather than a paper-like feel.

A still further aspect of the present invention provides a process for impregnating web-laid fibrous webs with a foamed latex binder composition which is capable of precision control without complication by personnel normally skilled in the operation of web-making machinery and which is applicable to the relatively thicker or bulkier types of webs.

The method of the present invention operates in a novel manner whereby the binder composition is broken up into small particles which rain down on the top surface of the web in the manner resembling the paint in the electrostatic, curtain-type or other types or projection painting processes. This novel action is subject to control by varying any of (1) the amount or strength of suction and its location below the web, with respect to the transfer surface, (2) the distance between the binder layer on the transfer surface and the top of the web, and (3) the rotational speed of the transfer surface. One can appreciate that the closer the surface of the binder layer on the transfer surface is to the surface of the web, without actual contact between the two, the larger will be the role of suction in pulling the binder layer off the transfer surface.

There may be situations where higher rotational speed of the transfer surface will be of assistance in causing the desired type of transfer of binder. One such situation is where the web is moving at a high rate of translational speed, for example 100 to 500 m/min, where, at too low a rotational speed of the transfer surface, too thick a layer of foam on the transfer surface would be required to reach the desired binder concentration in the web. Another such situation is where one of the thicker, bulkier webs is being impregnated and again a thicker binder layer than is desirable may be required. In these and similar situations, a higher rotational speed of the transfer surface permits a thinner coating on the transfer surface and closer spacing of transfer surface of the web. The rotational speed of the transfer surface should preferably in any event be lower than that which will cause the foam to reach the web in other than in a direction substantially normal thereto and to leave the roll in a direction other than essentially tangent to the transfer surface.

The process according to the present invention makes it possible to impregnate fibre webs of nearly any desired structure and thickness and, in fact, the method is particularly well adapted to the production of the relatively thick and bulky (low density) webs formerly made with success only by beater box addition of binders. Thus, fibre webs of the very thin gauze-like variety such as are utilized in making tea bags can be impregnated in this way as may also the very thick and fluffy webs such as are utilized as hand towels, wash cloths, for example, tea-towels, and fibre filler or insulating applications for example interlayers or garments. Webs weighing from as little as 5 to 10 grams per square meter to as much as 400 to 600 grams or higher per square meter and comprised of low denier fibers between 4 and 45 mm in length can, for example, be impregnated with any desired weight of binder material needed in the final product. Due to the very uniform dispersion of the foam throughout the web before coagulation or drying occurs the hand will be better and relatively less binder for any desired web integrity may be utilized. No migration of the foamed binder is observed in the product.

The method affords precision control not afforded by other methods. Firstly, the foamed binder is formed into a layer of a predetermined thickness with great accuracy and uniformity on the smooth surface of the transfer roll surface, for example, by a simple doctor blade. The thickness of the coating is very easily varied by this means should conditions warrant it and this is achieved without disturbing the web itseld in any way and without disturbing any of the adjustments of the web-forming machine, per se. Also, the height of the transfer roll above the web can be varied up or down to accommodate various thicknesses of web and/or to improve the transfer of foam from the roll to the web. Lastly, the rotational speed of the transfer roll itself can be varied independently of the rate of longitudinal travel of the web thereby affording quite precise control over the amount of foam being transferred to the web. In the last connection, speed sensors associated with the screen itself or with any of the rolls of the web-forming machines can be employed to generate signals to control the transfer roll drive and thereby lock the rotational speed of the transfer roll in any desired relationship to the rate of longitudinal travel of the web thereby increasing the accuracy of control over the application of the foam to the web.

The method according to the present invention may be applied to fibre webs made from very widely differing fibrous materials, for example: rayon fibres, shredded or non-shredded cellulose, nylon (polyamide) fibres, polyester fibres, polypropylene fibres, polyvinyl chloride fibres, glass fibres, metal fibres, and other available fibrous materials which may be processed on paper making type wet-laid web machines. In particular, mixtures of any of the above and still other fibres may be impregnated. The efficiency of impregnation makes such efficient use of common binder materials as to easily permit at least partial substitition of less expensive fibres such as cellulose and/or wood pulp in many products without sacrifice of strength and feel. It is preferred to apply the process of the invention to the impregnation of fibre webs comprised of synthetic fibres. When the foam is applied, the web should preferably be in the water-wetted condition such as obtains in the webs as carried in the wet screen area of a wet-laid non-woven web-making machine. Such webs usually contain between 50% and 125%/wt. of water and most preferably about 100%/wt. as is most common in web-making machines. Pre-formed webs being treated outside of a web-making machine should be wetted to contain water within the above-given range of proportions before applying the foam to guard against destruction of the foam by water loss before it is uniformly distributed through the web. Water content above 125%/wt. dilutes the binder too much and, moreover, increases drying costs. The proper water content of the web may be especially important when the web being treated contains the more absorbent fibres such as cellulose pulp fibres.

The binder utilized in the foamed binder composition utilized in the present invention may be any naturally-occurring or man-made dispersion of naturally-occurring polymeric material such as natural rubber, balata, etc. or any latex of a synthetic polymeric material obtained by the emulsion polymerization of a vinylidene type compound, i.e. a polymerizable compound containing one or more $CH_2{=}C<$ groups, such as polyvinyl chloride and vinyl chloride copolymers with one or more copolymerizable vinylidene compounds such as vinyl acetate, styrene, propylene, the alkyl acrylates, vinylidene chloride, acrylonitrile, acrylic acid, and other; the alkyl acrylate homopolymers and copolymers of the alkyl acrylates with acrylamides such as N-methylol acrylamide or methacrylamide, styrene, methyl methacrylate, acrylonitrile, acrylic acid, and many others; homopolymers of conjugated dienes containing 4 to 8 carbon atoms per molecule such as butadiene, isoprene, 1,4-dimethyl-butadiene-1,3, and others and copolymers of such dienes with one or more other monomers such as styrene, acrylonitrile methyl acrylate, ethyl acrylate, methyl methacrylate, N-methylol acrylamide or N-methylol methacrylamide, isobutene, and many others; polychloroprene; and other such polymeric materials and including mixtures of latices of any of the above and other polymeric materials.

Preferred latices are those of vinyl chloride to contribute anti-combustion characteristics; the latices of rubbery diene homopolymers and copolymers; and the alkyl acrylate homopolymers and copolymers. Most preferred latices are those of the latter types which have been modified by the incorporation of small amounts of a copolymerized polymerizable carboxylic acid such as acrylic acid offering the possibility of controlled hydrophilicity and adhesion through varying degrees of neutralization of the combined carboxyl groups; and those modified by incorporation of one or more self-curing groups such as halogen-containing monomers such as vinyl chloroethyl ether or vinyl benzyl chloride or the N-methylol acrylamide type monomers.

The proportion of the binder polymeric material in the web product produced by the method depends, inter alia, on the nature of the fibre web and its intended uses, on the kind of fibre used and on its staple length and diameter (denier) as well as on the thickness and strenth required in the finished and dried web, and on the other desired properties of the bonded, impregnated and dried web including hand or feel. The proportions used are generally in the range from about 10% to about 50% wt. of dry binder solids based on the dry weight of web.

The binder composition applied to the web is usually in the form of a latex which is a stable aqueous dispersion of polymeric material. No special additives are required since the process operates quite well with ordinary non-gelling latex formulations which are merely dried by the equipment to stable form in the web. The composition should contain 40 to 65%/wt. of dry solids.

Consistently better results are obtained, however, if the binder composition has been heat-sensitized by addition of one or more heat-sensitizing additives which operate to gel, coagulate or set the binder composition in the web on first exposure to the low temperature drying of the first drying sections of the usual web-making machine.

The heat sensitizing agent employed in the preferred latex binder compositions employed in the process of the present invention should have the characteristics of (1) being water-soluble, (2) remains inactive with no effect on impregnation of the web, and (3) operates to gel, coagulate or fix the foamed latex binder under the conditions of temperature and humidity such as exists in the drier rolls of web-forming machines. Temperatures between about 25° and about 95° C. are usually obtained in such sections of the machines. For this purpose, it has been found that the best heat-sensitizers are silicone polyethers, functional siloxane or silanol compounds such as the siloxane oxyalkylene block copolymers and organopolysiloxanes. Silicone heat sensitizers of this type are described in U.S. Pat. Nos. 3,255,140; 3,255,141; 3,483,240; and 3,702,315 as well as in British Pat. Specification No. 1,284,064.

The proportion of heat-sensitizer incorporated in the latex before foaming in the process of this invention is dependant, inter alia, on the type of latex utilized, the coagulation temperature available in the particular web-making machine utilized and on the machine (web) speed. Generally, the proportion will be in the range from about 0.05 to about 3%/wt. calculated on the dry weight of the latex solids. More efficient heat sensitizers will be utilized in the range of from about 0.05 to 1.0%/wt. on the same basis.

U.S. Pat. No. 3,702,315 and British Pat. Specification No. 1,284,064 show that the silicone polyethers are particularly effective when added to a binder latex containing small proportions of an organo-sulfonate stabilizing dispersant compound containing at least one aromatic ring per molecule such as, for example, alkylarylsulfonate emulsifiers such as "Santomerse S" (Trade Mark of Monsanto) said to be a sodium salt of a decyl benzene monosulfonate. When so utilized, only from about 0.05 to 1%, more usually from 0.05 to 0.5%/wt. of the silicone polyether need be utilized. Within such ranges it is possible to adjust the point of gellation of the binder at any temperature in the range of 25° to 95° C. most readily attainable in drying rollers of paper making machines.

The binder composition may contain other additives either already present in the binder or specially added to the binder composition. For example, it may be desirable for the binder to contain added dispersants and/or foaming Agents as well as resin and/or rubber type stabilizers, age-resistors, ultra-violet screening agents, antiozonants, and the like to protect the polymeric content of the web. Likewise, as is disclosed in British Pat. Specification No. 1,284,064, the addition of small amounts of a carboxylic acid can assist in adjustin g the gel point temperature of the foamed binder composition within the range above specified.

Thickening agents, coloring agents, ultra-violet intensifiers or dyes which fluoresce in the blue region and act as whiteners may be utilized. The binder composition preferably contains no large proportion of fillers or pigments or loading agents when best hand is desired in the finished web, usually not above about 10%/wt. based on the dry polymer solids.

The binder composition is foamed in any of the known ways such as by whipping air into it by means of vigorous mechanical agitation or by addition of a chemical foaming agent. The resulting foam should have a viscosity below that evidenced by a foam of density not less than 50 grams per liter where it begins to be too stiff. Less highly foamed compositions of density of from about 50 to 150 grams per liter may be utilized.

The present invention will now be further described with reference to the accompanying drawings in which:

FIG. 1 is a schematic view in side elevation of a typical installation of a wet-laid web-making machine incorporating the process of this invention, and FIG. 2 is enlarged side elevation partially in section of the wet-screen area of the machine of FIG. 1 showing the positioning of the impregnating station including the transfer roll and impregnating suction pans beneath the transfer roll area.

In FIG. 1, the typical wet-laid web-making machine, a modified paper-making machine, is shown to consist of a pulper chest 10 where the dry fibres are agitated or beaten in water by means of a beater agitator 11 to form a slurry in water. The chest 10 discharges into either of two machine chests or hold-up tanks 12,12 which are equipped with a system of valves 13 and volumetric pumps 14 to enable one tank 12 to supply slurry to the web-machine through pipe 15 while the other is receiving successive batches of slurry from pulper 10. The slurry passes through line 15 to the submerged wet-screen area of the machine comprising a screen 16 disposed with one of its lower ends immersed in the fibre slurry. Primary suction pans 17,17 are disposed beneath the screen in the portion thereof immersed in the slurry to draw slurry onto the screen and build up a deposit of fibres thereon.

The screen 16 operates over a plurality of idler rollers 18 and over a drive roller 19 arranged also for vertical movement to tension the screen.

The transfer roll station A (which is shown in greater detail in FIG. 2) employed in the process of the present invention is disposed just outside the housing of the submerged wet-screen area in the top region of the upwardly-inclined flight of the screen and before the first drier roll section of the machine. Beneath the screen just below the transfer roll station there are disposed a plurality of impregnating suction pans 20 each provided with a valve enabling one or more of the pans to be disabled if not required for efficient drawing of the foam into the web. One can also position the application of suction anywhere from several points just ahead of the roll by means of plural section pans; it can be confined to the area immediately below the roll; or even to any of several zones immediately following the zone of application of the foam. The selection of these suction pans, it will be understood, will depend on foam viscosity, thickness of the web and speed of the screen.

FIG. 2 of the drawings shows the details of the foam application station as installed in a machine of FIG. 1 and in larger size and somewhat greater detail. A roll 30 having a smooth surface is mounted for vertical travel and disposed above the screen 16 and web 31 and enclosed in a hopper 32 comprising a pair of end walls 33, an inclined wall 34 and a substantially vertical wall 35, the lower portion of which terminates short of the roll 30. A doctor knife blade 36 is secured to the lower end of vertical wall 35 and is slotted and fastened in place by a plurality of wingnuts 37,37 to allow vertical adjustment of the knife relative to the roll thereby controlling the depth of coating applied to the surface of the roll. Foamed binder is fed to the hopper 32 as it is consumed.

Following the transfer roll section the screen carrying the now impregnated fibrous web passes over a downwardly-inclined flight to a pair of drier rolls 40,40 (for e.g. drying and/or coagulation) each provided with a screen or porous felt 41 which presses the web against the surface of the hot rolls 40,40 and permits the escape of water vapor (FIG. 1). From the first pair of drier rolls the web then passes to an auxiliary treatments section comprising an upper screen 50 on which the web may be supported while it may be sprayed with another binder or surface finishing composition and a lower drier roll 51 having a screen or felt 52 which transports the web and presses it against the auxiliary drier roll 51. Screen 50 and drier roll 51 are arranged such that the web can pass first over spray screen 50 and thence to roll 51 for drying or neat-setting, or as shown in FIG. 1, the screen 50 is by-passed and roll 51 is used as an auxiliary drying roll.

From the Auxiliary Treatments section, the web 31 passes to a final air drier over two contra-rotating drier rolls 60,61 in series.

Rolls 60,61 are enclosed in a housing 62 to which is supplied heated air to dry the web to 1%/wt. or less of moisture. The final dried web finally passes to a take-off station where one or several removal rolls 70 are provided on which the dried web is rolled up for temporary storage or shipping.

The invention will now be further described by way of the following Example which is intended to be illustrative only and not limiting in any way.

EXAMPLE

A synthetic rubber latex known as "Hycar 2600 H60" an acrylic (acrylate) latex made by Chemische Industrie AKU-Goodrich B.V. containing about 46.5%/wt. of polymer solids is compounded as follows:

| | Pa rts/wt. | |
|---|---|---|
| Material | Sample A | Sample B |
| Latex | 215 | 215 |
| Heat-Sensitizer (1) | 5 | 5 |
| Oxalic acid (2) | 7.5 | — |
| Water | 271 | 263 |
| Ammonium chloride (2) | 15 | 40 |
| Stabilizer (3) | — | 10 |

(1) Polysiloxane coagulant such as General Electric SF 1187; added as 10%/wt. solution in water.
(2) Added as a 10%/wt. aqueous solution.
(3) Vulcastab LW, ICI, a non-ionic soap, added as a 20%/wt. aqueous solution.

The heat sensitive formulations A and B, which coagulate at about 44° C are converted to foam by beating with air to a cup weight or density of about 100 grams per liter. The resulting foamed binder compositions are applied to light weight synthetic fiber non-woven web (mixture of polyester and rayon fibers) weighing from 16 to 50 gram/sq meter using the above described apparatus operating at a web speed of 100 meters/minute. The resulting impregnated webs containing about 25%/wt of binder based on the dry weight of web are bulkier and have a softer hand than comparable webs made by spraying or by any other technique referred to above. The webs have integrity equal to or superior to similar webs made by other procedures.

I claim:

1. In a process for the preparation of a nonwoven fiber web with a weight in the range of 5 to 6 grams per square meter and comprising synthetic fibers between 4 and 45 mm. in length, made by the wet method on a paper machine, said web containing from 50% to 125 wt. % of water and being impregnated with a foamed aqueous binder composition having a density not less than 50 grams per liter while said web passes through a screening area of the paper-making machine, said aqueous binder composition being heat sensitized to coagulate in the temperature range of 25° to 95° C., drawing said layer of foamed composition into said web by means of suction applied to the underside of said web, and drying the resulting web and its content of foamed binder composition to coagulate said foamed binder composition, the improvement which comprises applying said foamed binder composition to a rotating cylindrical transfer surface disposed above the said web at a distance from the top surface of the web greater than the thickness of the layer of composition to be applied to said web.

2. A process as claimed in claim 1 wherein there is applied to the fibrous web between about 19% and 50% wt. of dry binder solids based on the dry weight of web.

3. A process as claimed in claim 1 wherein the said aqueous binder composition is an aqueous latex of a synthetic polymeric material obtained by the polymerization of a polymerizable compound containing one or more $CH_2{=}C<$ compounds, said binder composition containing between 40% and 65%/wt. of total binder solids, and said binder having been rendered sensitive to coagulation on being heated to a temperature in the range of 25° to 95° C. by the addition thereto of a heat-sensitizing additive.

* * * * *